US012005294B2

(12) United States Patent
Chen

(10) Patent No.: US 12,005,294 B2
(45) Date of Patent: Jun. 11, 2024

(54) ROPE PULL TRAINING DEVICE

(71) Applicant: Ya-Chi Chen, New Taipei (TW)

(72) Inventor: Ya-Chi Chen, New Taipei (TW)

( * ) Notice: Subject to any disclaimer, the term of this patent is extended or adjusted under 35 U.S.C. 154(b) by 84 days.

(21) Appl. No.: 17/729,064

(22) Filed: Apr. 26, 2022

(65) Prior Publication Data

US 2023/0338770 A1 Oct. 26, 2023

(51) Int. Cl.

| | |
|---|---|
| ***A63B 21/00*** | (2006.01) |
| ***A63B 21/012*** | (2006.01) |
| ***A63B 23/12*** | (2006.01) |

(52) U.S. Cl.

CPC ..... *A63B 21/151* (2013.01); *A63B 21/012* (2013.01); *A63B 23/12* (2013.01)

(58) Field of Classification Search

CPC ... A63B 21/151; A63B 21/152; A63B 21/153; A63B 21/154; A63B 21/155; A63B 21/156; A63B 21/157

See application file for complete search history.

(56) References Cited

U.S. PATENT DOCUMENTS

| | | | | |
|---|---|---|---|---|
| 6,527,683 | B2 * | 3/2003 | Tolles | A63B 23/00 482/99 |
| 7,704,195 | B2 * | 4/2010 | Alessandri | A63B 21/00072 482/99 |
| 8,172,733 | B1 * | 5/2012 | Batca | A63B 21/0628 482/99 |
| 10,556,144 | B2 * | 2/2020 | Habing | A63B 21/156 |
| 10,814,172 | B1 * | 10/2020 | Ilfrey | A63B 23/035 |
| 2022/0047909 | A1 * | 2/2022 | Beecroft | A63B 21/169 |
| 2022/0096891 | A1 * | 3/2022 | Yang | A63B 21/0428 |

* cited by examiner

*Primary Examiner* — Zachary T Moore
(74) *Attorney, Agent, or Firm* — Egbert, McDaniel & Swartz, PLLC

(57) ABSTRACT

A rope pull training device is disclosed, which includes a mainframe having a vertical post, two laterally opposite hauling ropes respectively configured on the mainframe, a resisting unit connected to the mainframe to provide a resisting force against the pulling force applied on the hauling ropes, and a guiding structure fitted on the vertical post, capable of sliding up and down along the vertical post. Each of the hauling ropes is respectively connected to the guiding structure, and each of the hauling ropes respectively goes through the guiding structure. One end of the hauling rope close to the guiding structure is connected with a handle. The hauling ropes are in a cyclic form. The hauling ropes can maintain a tightened state, and can be applied in different exercising modes.

8 Claims, 12 Drawing Sheets

ROPE PULL TRAINING DEVICE

CROSS-REFERENCE TO RELATED U.S. APPLICATIONS

Not applicable.

BACKGROUND OF THE INVENTION

1. Field of the Invention

The present invention relates generally to a muscle training device, and more particularly to a rope pull training device.

2. Description of Related Art Including Information Disclosed Under 37 CFR 1.97 and 37 CFR 1.98

In anaerobic muscle-training exercises, a substantial force is applied upon the muscle in a short time, and the muscle undergoes extensions and retractions periodically.

A rope pull training device is an exercising device using a rope for pulling. A conventional rope pull training device mainly comprises a mainframe, two ropes and a resisting structure, wherein the ropes are configured on the mainframe through one or a plurality of pulleys. One end of each rope is connected to a handle, the other end is connected to the resisting structure. The user grips the handles and pulls the rope. The resisting structure provides a resistance. The user provides a pulling force to overcome the resisting force, pulling the rope to move. In this way, the muscles at specific parts of the body can be exercised.

The two ends of each rope are respectively connected to the handle and the resisting structure. The curving and winding of the rope are influenced by the relative positions of the pulleys, the handles, and the resisting structure. Such conventional rope pull training device cannot be applied in different exercising modes.

BRIEF SUMMARY OF THE INVENTION

The main object of the present invention is to provide a rope pull training device, which can be applied in different exercising modes.

In view of the above object, the present invention provides a rope pull training device, which comprises a mainframe having a vertical post, an upper beam and a loading element. The vertical post is formed with a plurality of first positioning holes along the axle. The upper beam and the loading element are opposite each other in the vertical direction. The vertical post is connected to the upper beam and the loading element. A first connection structure is connected to the upper beam. A second connection structure is connected to the loading element. The first connection structure and the second connection structure are respectively connected to a support, so that the mainframe can be fixed on the support.

Two pulley units are provided, respectively comprising a plurality of fixed pulleys. The fixed pulleys are respectively configured on the mainframe. A resisting unit is connected to the mainframe. A guiding structure comprises a sleeve, two wheel seats, two first guide wheels and two second guide wheels. The sleeve can be sleeved on the vertical post and can slide back and forth along the axial direction of the vertical post. A pin rod is fitted into a selected first positioning hole, so as to position the sleeve. The laterally opposite wheel seats are respectively pivoted on the sleeve, so that each of the wheel seats can respectively rotate in relation to the sleeve. Each of the wheel seats respectively have a side plate. The side plates are respectively pivoted on one of the first guide wheels and one of the second guide wheels. The first guide wheels and the second guide wheels are adjacent to each other in the vertical direction.

Two laterally opposite hauling ropes are provided. Each of the hauling ropes respectively winds each of the fixed pulleys, so that the hauling ropes are respectively configured on each of the pulley units. Each of the hauling ropes is respectively connected to the sleeve, and each of the hauling ropes respectively goes through each of the wheel seats. One end of the hauling ropes close to the wheel seats is connected with a handle. The hauling ropes form a cycle between the sleeve and the wheel seat. The hauling ropes go between the first guide wheels and the second guide wheels from the side of the first guide wheels facing the sleeve. The first guide wheels and the second guide wheels form a limitation upon the hauling ropes along the radial direction of the hauling ropes, so as to guide the hauling ropes. The side plates form a lateral limitation on the hauling ropes, to prevent the hauling ropes from falling off the first guide wheels and the second guide wheels. The hauling rope has a lifting section.

Two movable pulleys are provided. Each of the lifting section respectively winds the bottom edge of each of the movable pulleys. Each of the movable pulleys respectively presses each of the lifting section downward, so that each of the hauling ropes is respectively in a tightened state. Each of the hauling ropes respectively pulls each of the movable pulleys to move back and forth toward or away from the resisting unit.

Two connecting ropes are respectively connected to each of the movable pulleys. Each of the connecting ropes is connected to the resisting unit/The resisting unit is configured to provide, through each of the connecting ropes and each of the movable pulleys, a resisting force against each of the hauling ropes pulled by the handles.

The hauling ropes are located between the sleeve and the wheel seats in a cyclic form. Through the downward force exerted by the movable pulleys upon the lifting section, the hauling ropes can be maintained in a tightened state, and can be applied in different exercising modes.

DETAILED DESCRIPTION OF THE INVENTION

Figure 1:
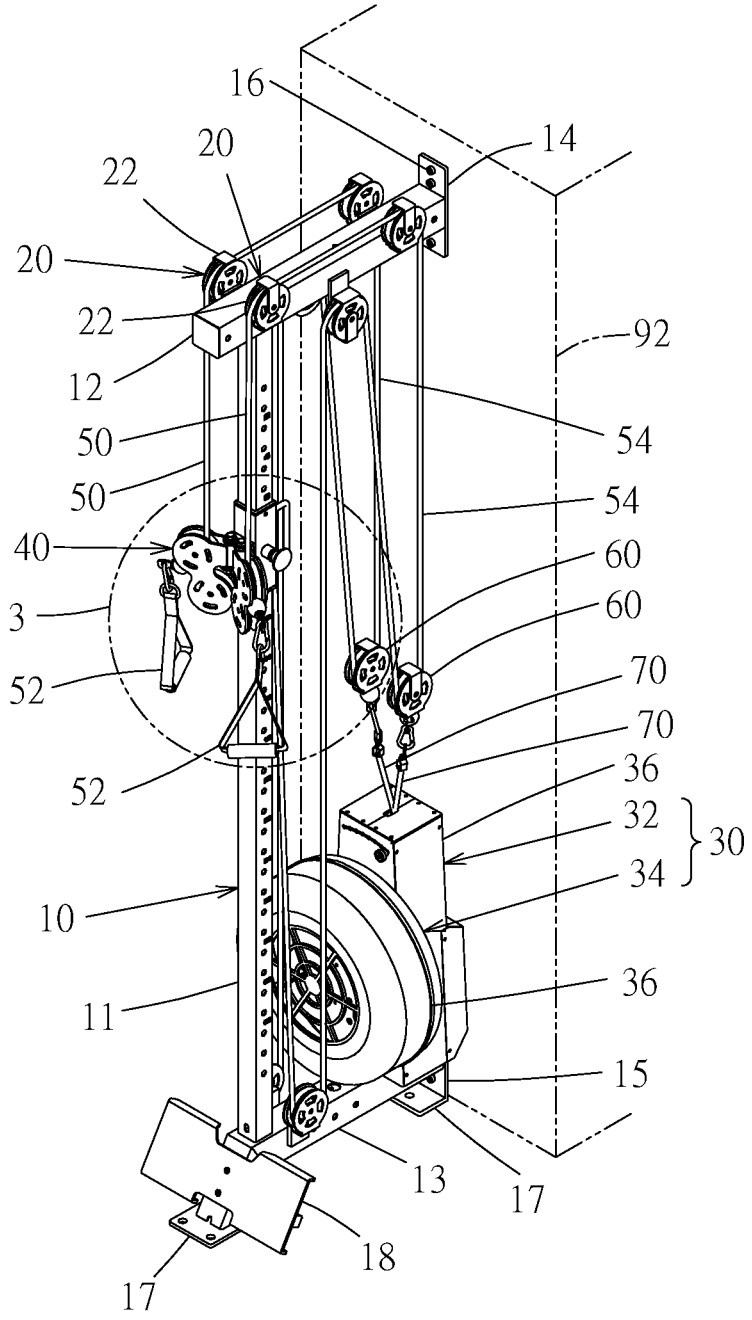
FIG. 1 is a perspective view of Embodiment 1 of the invention mounted on the wall.
Figure 2:
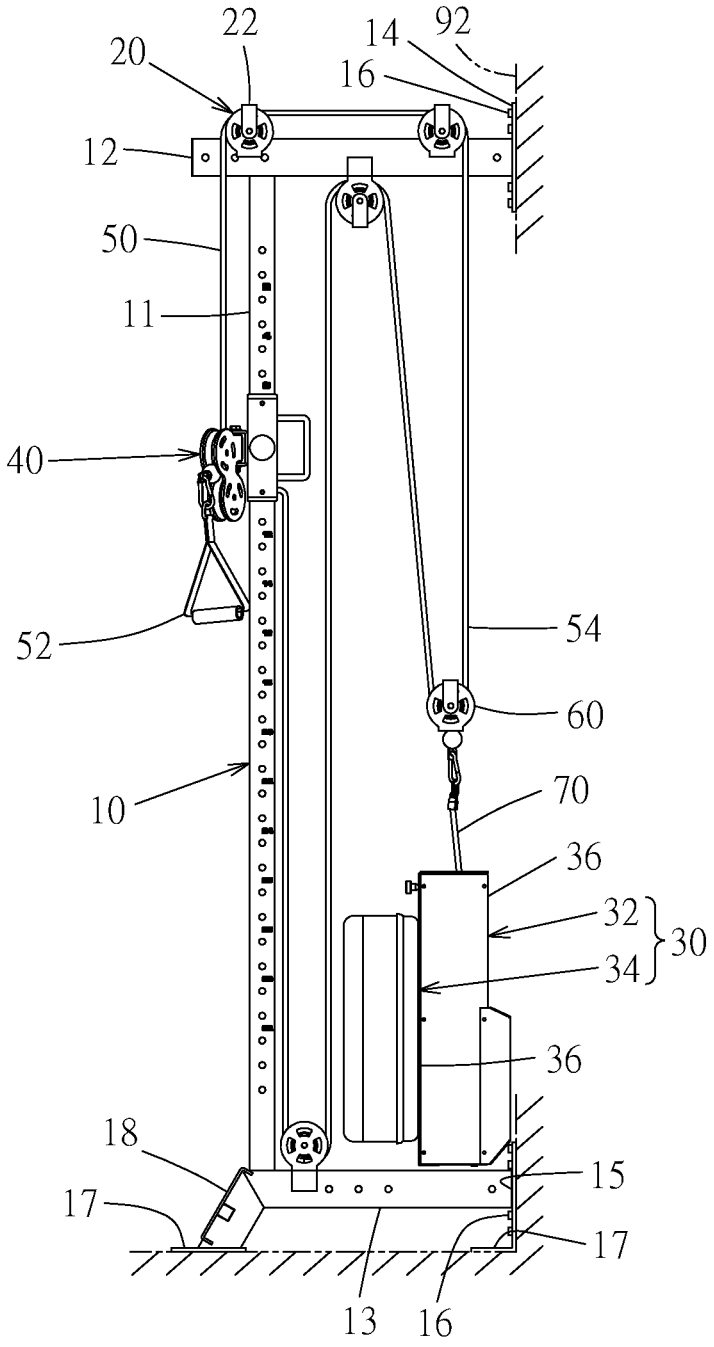
FIG. 2 is a right side view of Embodiment 1 of the invention.
Figure 3:
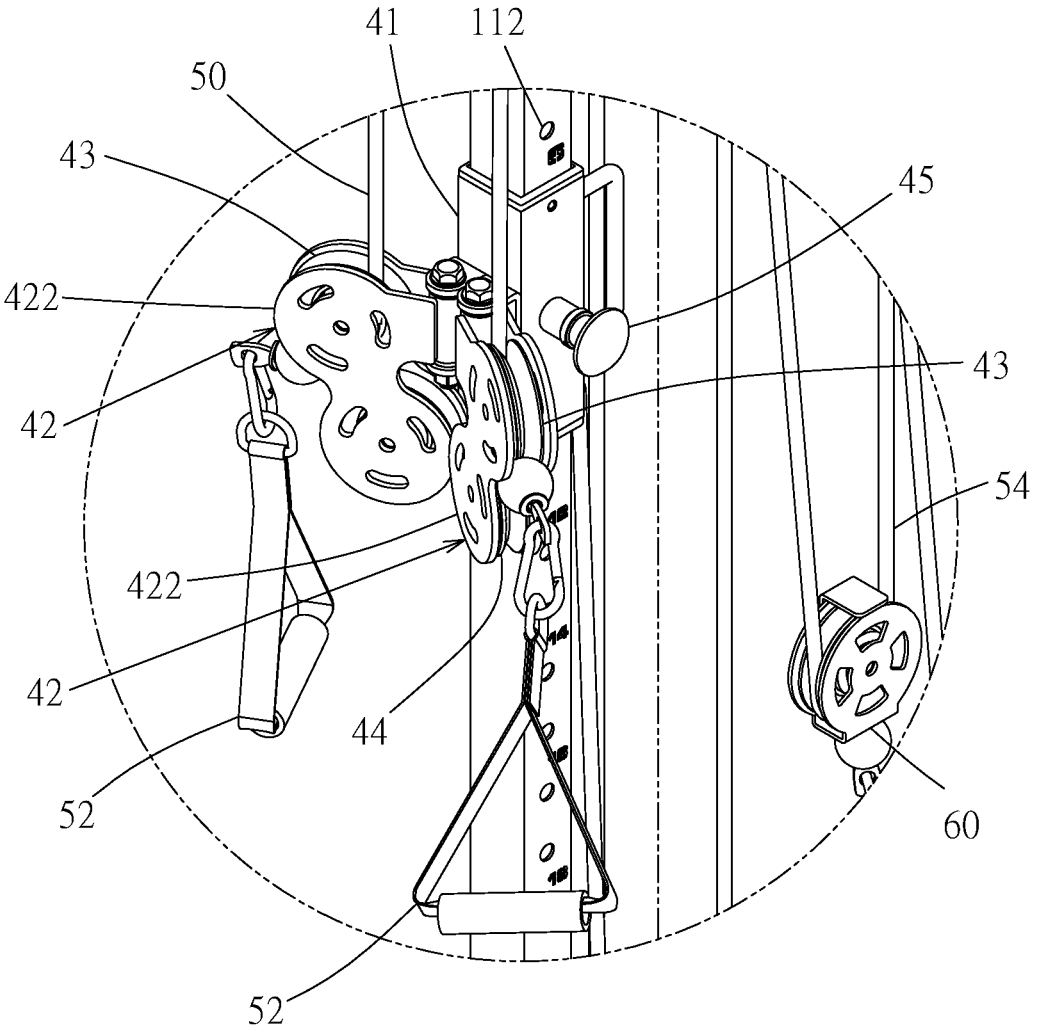
FIG. 3 is a partial enlarged view of FIG. 1.

Referring to FIGS. 1 to 6, Embodiment 1 of the rope pull training device comprises a mainframe 10, two pulley units 20, a resisting unit 30, a guiding structure 40, two hauling ropes 50, two movable pulleys 60 and two connecting ropes 70. The mainframe 10 comprises a vertical post 11, an upper beam 12 and a loading element 13. The vertical post 11 is formed with a plurality of first positioning holes 112 along the axle. The upper beam 12 and the loading element 13 are opposite each other. The vertical post 11 is connected to the upper beam 12 and the loading element 13. A first connection structure 14 is connected to the upper beam 12. A second connection structure 15 is connected to the loading element 13. The first connection structure 14 and the second connection structure 15 are respectively connected to a support 92, so that the mainframe 10 can be fixed on the support 92. In the present embodiment, the loading element 13 is formed by a long structure, and the support 92 is a wall. The support 92 can also be a frame (not shown in the figure).

Each of the pulley units 20 respectively comprises a plurality of fixed pulleys 22. Each of the fixed pulleys 22 are respectively configured on the mainframe 10, and the resisting unit 30 is connected to the mainframe 10.

The guiding structure 40 comprises a sleeve 41, two wheel seats 42, two first guide wheels 43 and two second guide wheels 44. The sleeve 41 can be sleeved on the vertical post 11 and can slide back and forth along the vertical post 11. A pin rod 45 is fitted into a selected first positioning hole 112, so as to position the sleeve 41. The wheel seats 42 are opposite each other laterally, and are respectively pivoted on the sleeve 41, so that each of the wheel seats 42 can respectively rotate in relation to the sleeve 41. Each of the wheel seats 42 respectively has at least one side plate 422, each of the side plates 422 is respectively pivoted on one of the first guide wheels 43 and one of the second guide wheels 44, and the first guide wheels 43 and the second guide wheels 44 are adjacent to each other in the vertical direction.

The two hauling ropes 50 are opposite each other laterally. Each of the hauling ropes 50 respectively winds each of the fixed pulleys 22, so that each of the hauling ropes 50 are respectively configured on each of the pulley units 20. Each of the hauling ropes 50 is respectively connected to the sleeve 41, and each of the hauling ropes 50 respectively goes through each of the wheel seats 42. One end of the hauling ropes 50 close to the wheel seats 42 is connected with a handle 52. The hauling ropes 50 form a cycle between the sleeve 41 and the wheel seat 42. The hauling rope 50 goes between the first guide wheels 43 and the second guide wheels 44 from the side of the first guide wheels 43 facing the sleeve 41. The first guide wheels 43 and the second guide wheels 44 limit the hauling ropes 50 along the radial direction of the hauling ropes 50, so as to guide the hauling ropes 50. The side plate 422 limits the hauling ropes 50 laterally, so as to prevent the hauling ropes 50 from falling off the first guide wheels 43 and the second guide wheels 44. The hauling ropes 50 have a lifting section 54.

Each of the lifting section 54 respectively winds around the bottom edge of each of the movable pulleys 60. The weight of each of the movable pulleys 60 presses each of the lifting section 54 downward, so that the hauling ropes 50 are respectively in a tightened state. When the user 94 controls each of the handles 52 to repeatedly pull each of the hauling ropes 50, the section of the hauling rope 50 located between the sleeve 41 and the wheel seat 42 in cyclic state will move back and forth in real time. Each of the hauling ropes 50 respectively pulls each of the movable pulleys 60 to move back and forth toward or away from the resisting unit 30.

Each of the connecting ropes 70 is respectively connected to each of the movable pulleys 60, each of the connecting ropes 70 is connected to the resisting unit 30, the resisting unit 30 is configured to provide, through each of the connecting ropes 70 and each of the movable pulleys 60, a resisting force upon each of the hauling ropes 50 pulled by the each of the handles 52.

Figure 4:
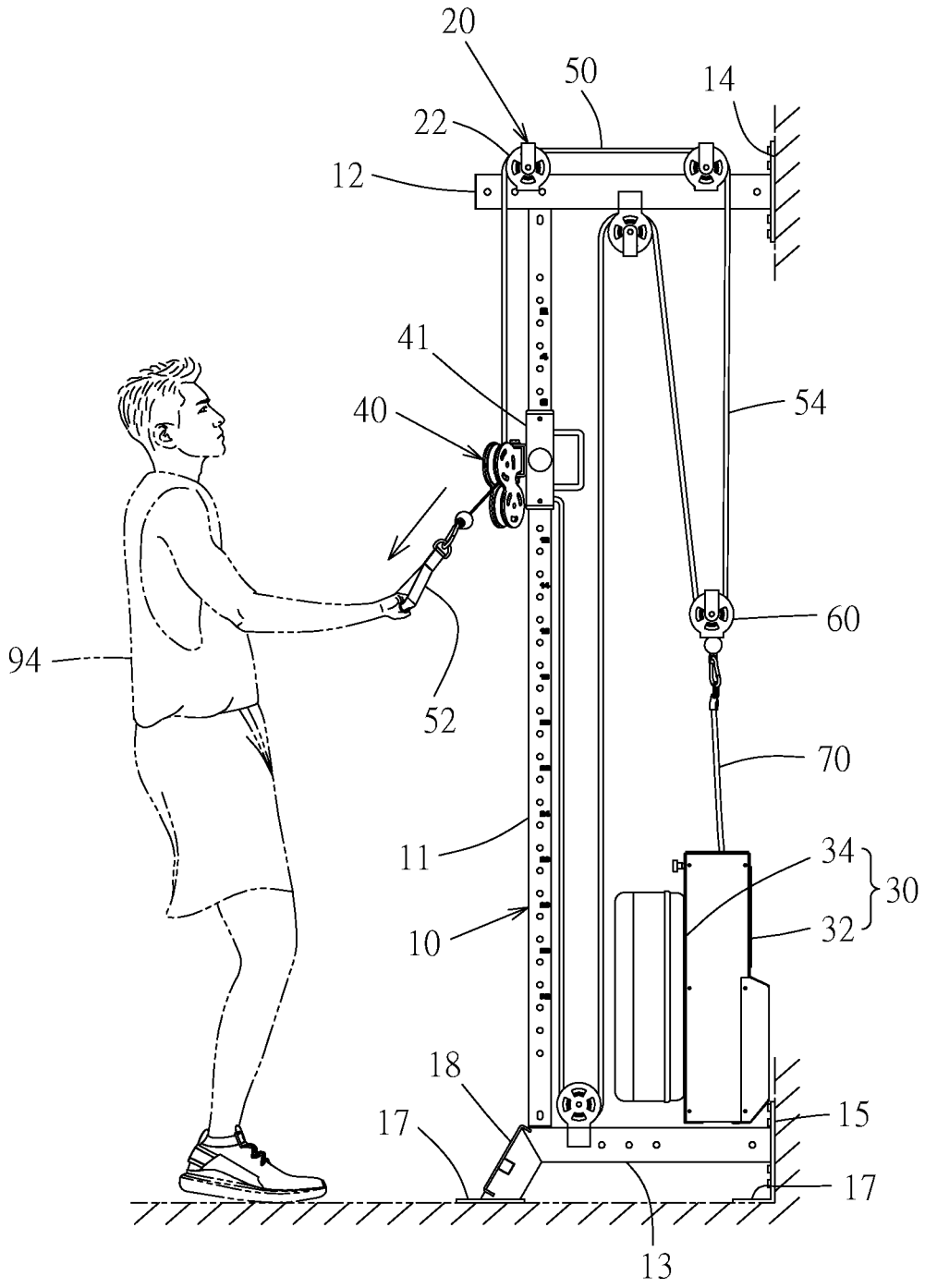
FIG. 4 is a right side view of an operational state of Embodiment 1 of the invention.

As shown in FIG. 4, the guiding structure 40 is located at a position of the vertical post 11 close to the upper beam 12. The user 94 is standing in front of the vertical post 11. The hands of the user 94 respectively control each of the handles 52. The user 94 pulls each of the handles 52 respectively in the direction away from the vertical post 11. Each of the hauling ropes 50 respectively pulls each of the fixed pulleys 22 to lift. Each of the fixed pulleys 22 respectively pulls the resisting unit 30 through each of the connecting ropes 70. The resisting unit 30 provides a resisting force. The user 94 must exert a pulling force to overcome the resisting force, so as to move the hauling ropes 50 and exercise the muscles at specific part of the body.

Figure 5:
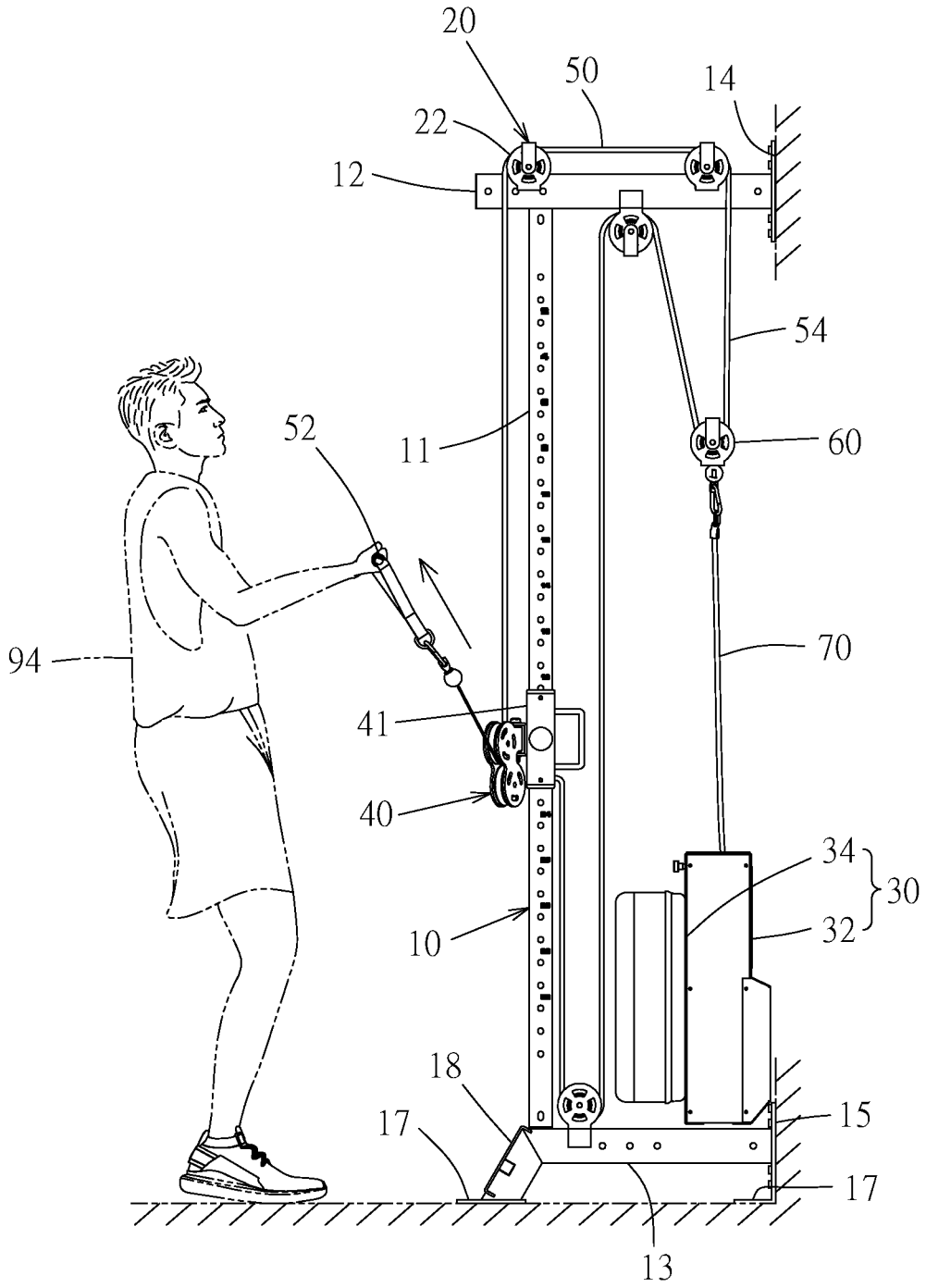
FIG. 5 is a right side view of another operational state of Embodiment 1 of the invention.

Referring to FIG. 5, the guiding structure 40 is located at a position of the vertical post 11 close to the loading element 13. The user 94 stands in front of the vertical post 11. The two hands of the user 94 respectively control each of the handles 52. The two hands of the user 94 respectively pull each of the handles 52 away from the vertical post 11. The resisting unit 30 provides a resisting force. The user 94 need to exert a sufficient force to overcome the resisting force, so as to move the hauling ropes 50, and exercise the muscles at specific parts of the body.

The hauling ropes 50 are located between the sleeve 41 and the wheel seat 42 in a cyclic state. The downward force applied by the movable pulleys 60 upon the lifting section 54 changes the height of the guiding structure 40 on the vertical post 11. The hauling ropes 50 can maintain a tightened state. When the handles 52 are pulled, the hauling ropes 50 can move simultaneously, and different exercising modes can be realized. Each of the wheel seats 42 can, based on the movement directions of each of the handles 52, respectively rotate in relation to the sleeve 41.

The user 94 can use both hands to pull both handles 52 at the same time, or to pull each of the handles 52 alternately. The user 94 can stand back toward the vertical post 11, and pull the handles 52 toward the front side of the user 94. The user 94 can operate the handles 52 while sitting, or the user 94 can lie in front of the vertical post 11 while operating the handles 52. The frame structure of the handles 52 depicted in the figures can be changed to a soft strap structure, so that, the handles 52 in form of soft straps can be wrapped on the feet of the user 94. Thus, the user can use both feet to pull the handles 52. All the above-described forms can be the exercising modes in which the present invention is applied.

In the present embodiment, the first connection structure 14 and the second connection structure 15 are respectively in form of a vertical plate. The first connection structure 14 and the second connection structure 15 respectively abut against the support 92. The first connection structure 14 and the second connection structure 15 are respectively fixed on the support 92 through screw bolts 16.

The mainframe 10 has two legs 17, so that the mainframe 10 can stand on the ground. The number of legs 17 can be increased or decreased as needed.

The mainframe 10 is configured with a connecting plate 18. The connecting plate 18 is connected to an external structure (not shown in the figure). The external structure can be a platform, or a bed, or a chair, thus providing operational convenience in different exercising modes.

The resisting unit 30 comprises a reel structure 32 and a resisting structure 34, wherein the reel structure 32 and the resisting structure 34 respectively has a shell 36. The reel structure 32 and the resisting structure 34 are linked. The reel structure 32 is configured to wind or release each of the connecting ropes 70. The resisting structure 34 is configured to provide a resisting force when the reel structure 32 releases each of the connecting ropes 70. The resisting structure 34 is a prior-art technique familiar to and readily understandable by those in the technical field of the invention.

Figure 6:
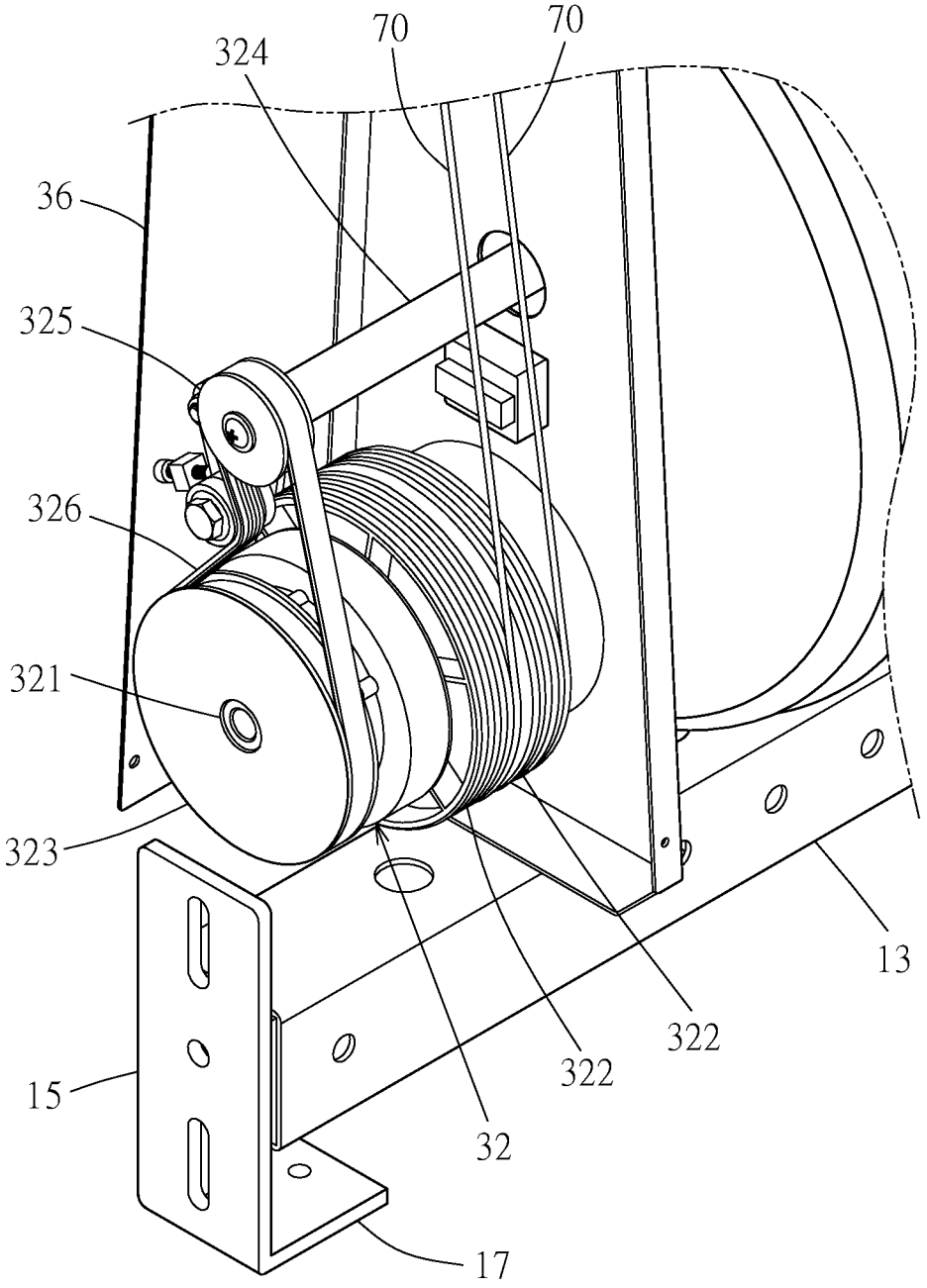
FIG. 6 is a perspective view the reel structure of Embodiment 1 of the invention.
Figure 7:
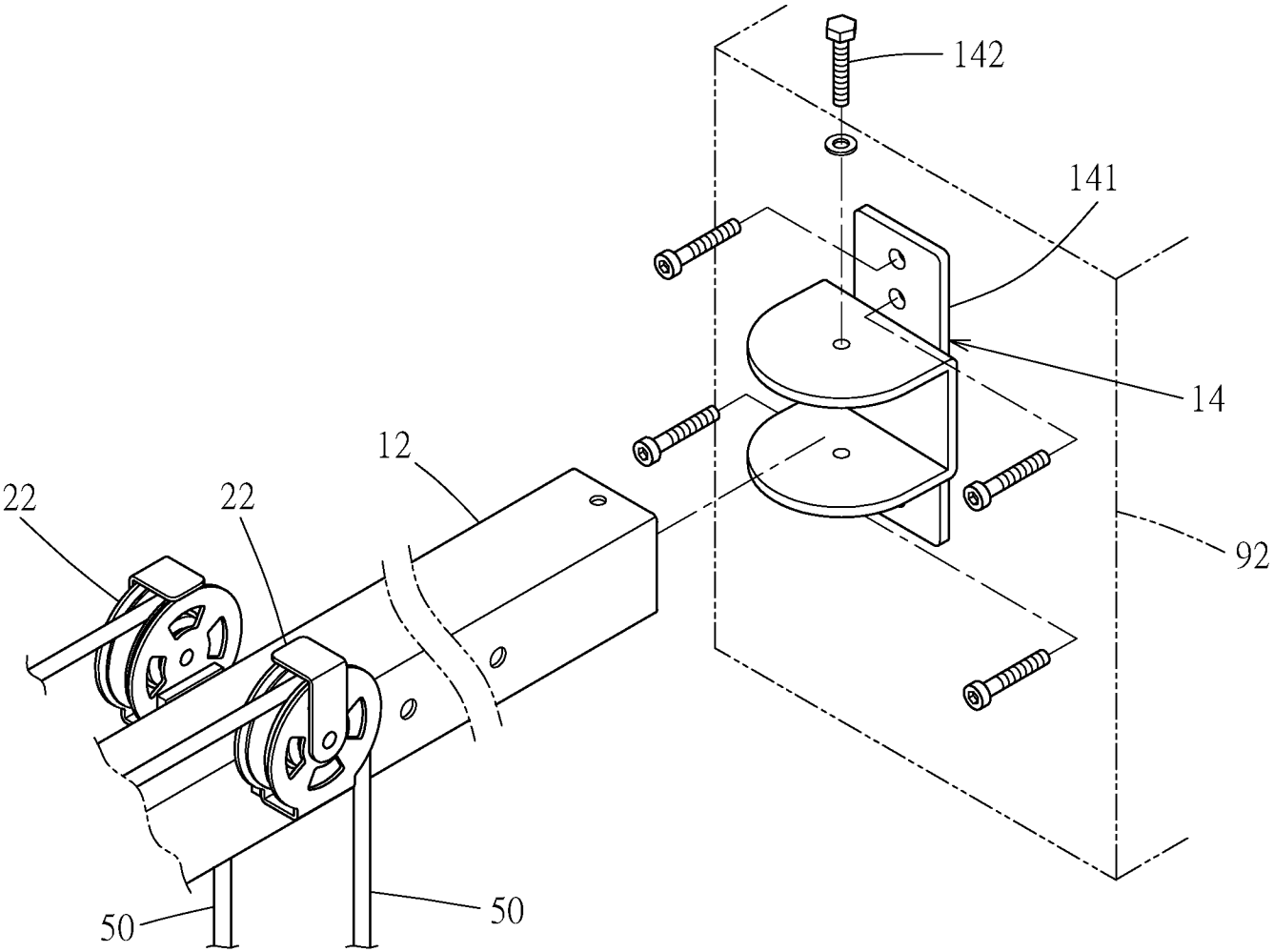
FIG. 7 is a partial exploded perspective view of Embodiment 2 of the invention, showing the first connection structure.
Figure 8:
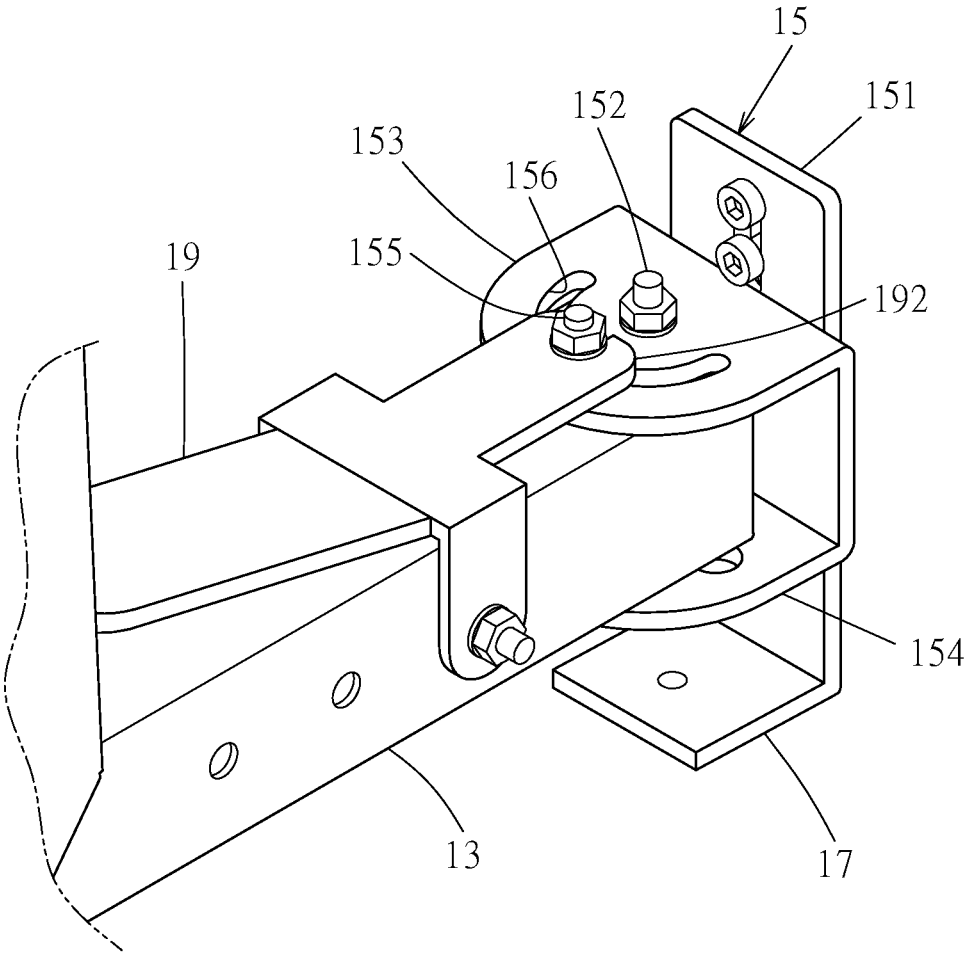
FIG. 8 is a partial perspective view of Embodiment 2 of the invention, showing the second connection structure.
Figure 9:
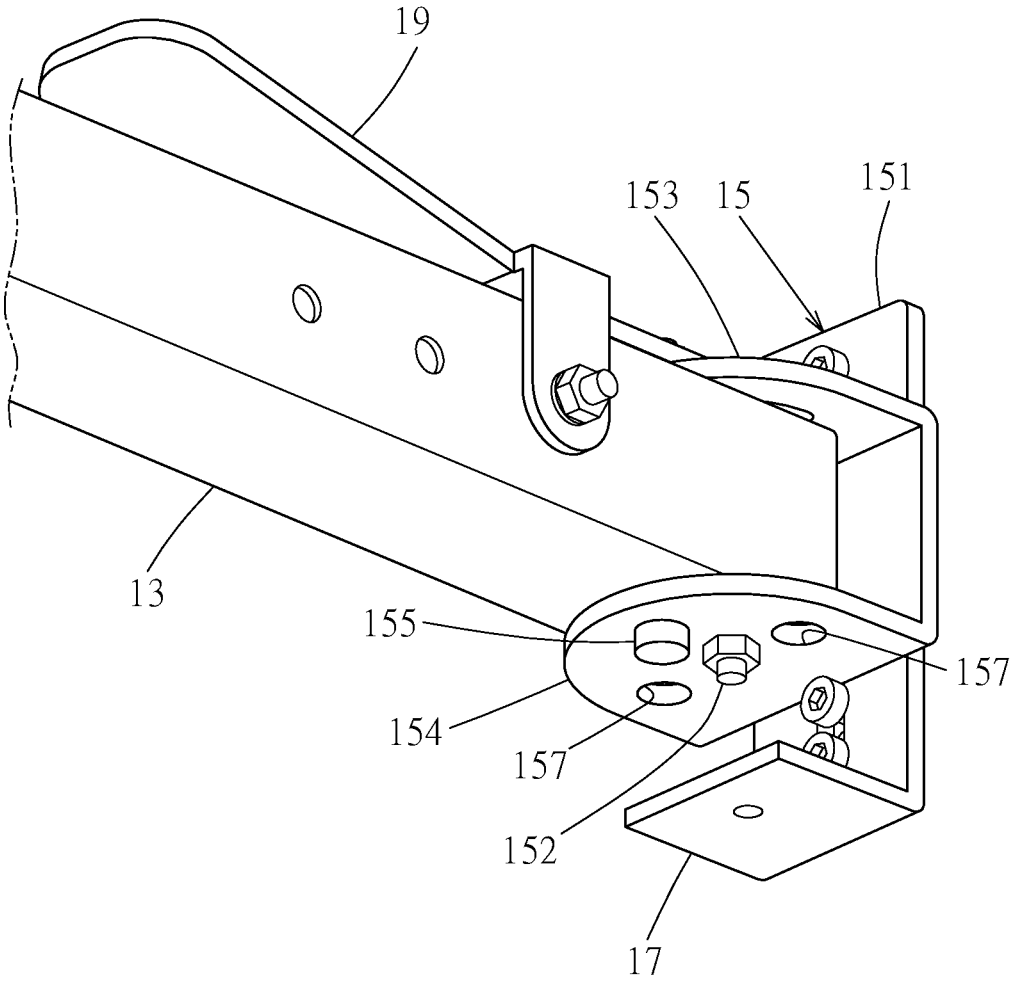
FIG. 9 is a partial perspective view of Embodiment 2 of the invention from another angle, showing the second connection structure.
Figure 10:
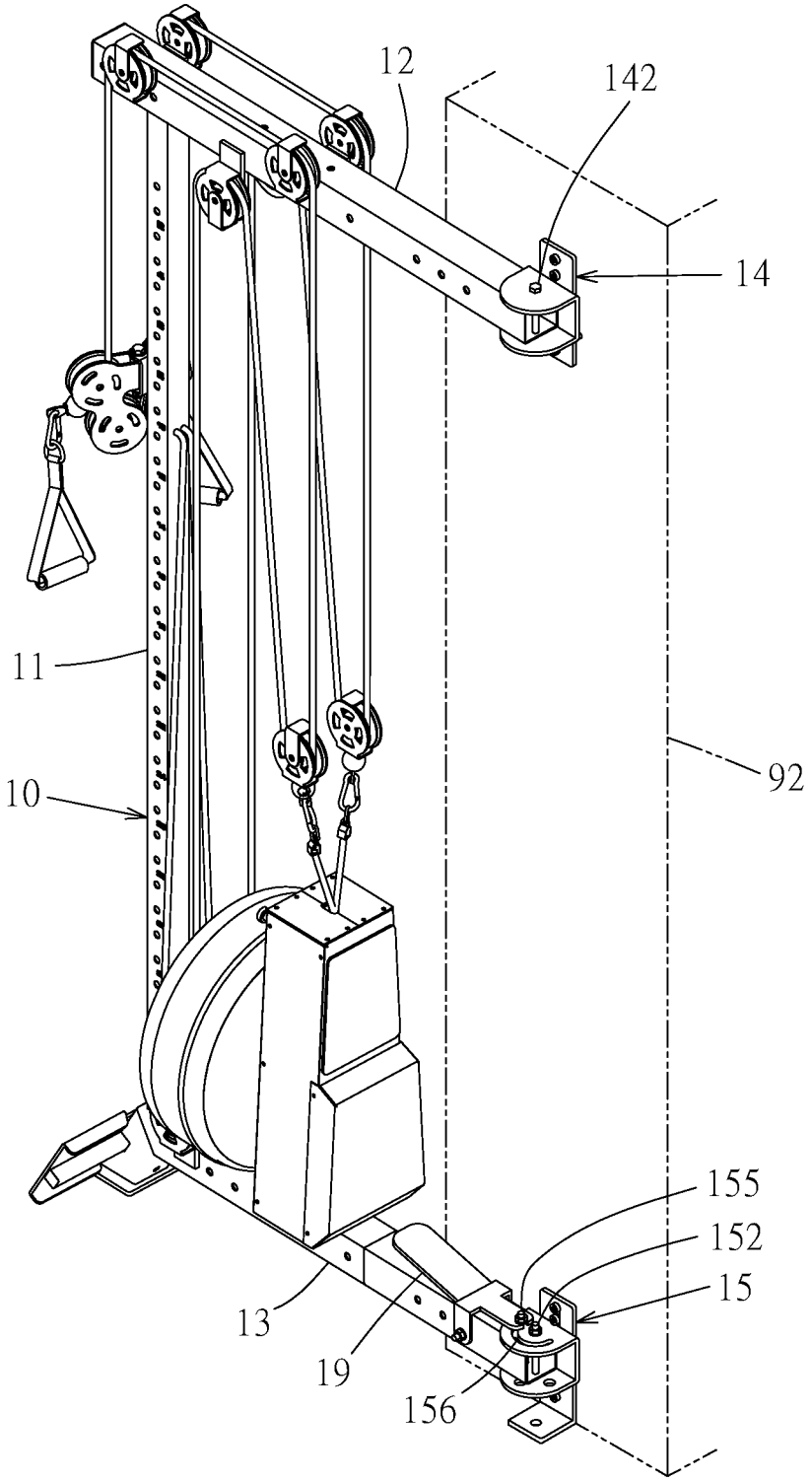
FIG. 10 is a perspective view of Embodiment 2 of the invention mounted on the wall, showing the idle state.

Referring to FIG. 6, the reel structure 32 comprises a first shaft 321 and two winding wheels 322, wherein the first shaft 321 goes through each of the winding wheels 322, each of the connecting ropes 70 is respectively connected to each of the winding wheels 322, and each of the connecting ropes 70 is respectively wound around the radial periphery of each of the winding wheels 322, so that each of the winding wheels 322 can respectively wind or release each of the connecting ropes 70.

The rotational direction of each of the winding wheels 322 when winding the connecting ropes 70 is defined as the winding direction, whereas the rotational direction of each of the winding wheels 322 when releasing the connecting ropes 70 is defined as the releasing direction. Each of the winding wheels 322 respectively pulls the first shaft 321 to have one-way rotation in the releasing direction. Each of the winding wheels 322 is respectively connected to an elastic element (not shown in the figure), so that each of the winding wheels 322 is configured to respectively and automatically wind each of the connecting ropes 70 in the winding direction. The embodiment of the elastic element can be a volute spring or an equivalent component.

As an option, each of the winding wheels 322 can be respectively connected to the first shaft 321 through a one-way pulling mechanism (not shown in the figure), so that each of the winding wheels 322 can only rotate when the releasing direction pulls the first shaft 321. The one-way pulling mechanism is a prior-art technique familiar to and readily understandable by those in the technical field of the invention.

The first shaft 321 is axially fitted in a first belt pulley 323, and a second shaft 324 is axially fitted in the resisting structure 34 and a second belt pulley 325. A ring-shaped transmission belt 326 is lashed on the first belt pulley 323 and the second belt pulley 325, so that the reel structure 32 and the resisting structure 34 can move simultaneously.

Referring to FIGS. 7 to 10, Embodiment 2 differs from Embodiment 1 in that, the first connection structure 14 comprises a first frame body 141 and a first bolt 142, the first frame body 141 is connected to the support 92, the first bolt 142 vertically goes through the first frame body 141 and the upper beam 12, the second connection structure 15 comprises a second frame body 151 and a second bolt 152, the second frame body 151 is connected to the support 92, the second bolt 152 vertically goes through the second frame body 151 and the loading element 13, the upper beam 12 and the loading element 13 respectively rotate around the first bolt 142 and the second bolt 152.

When Embodiment 2 in an idle state, and no one is exercising, the mainframe 10 can rotate around the first bolt 142 and the second bolt 152, so that the vertical post 11 can move toward the support 92, thus reducing the length of the mainframe 10 protruding in front of the support 92, and providing convenience with a larger space in front of the support 92.

The second frame body 151 has an upper wing plate 153 and a lower wing plate 154. The upper wing plate 153 and the lower wing plate 154 are respectively adjacent to the top edge and bottom edge of the loading element 13. The second bolt 152 vertically goes through the upper wing plate 153, the lower wing plate 154 and the loading element 13. A positioning pin 155 goes through the upper wing plate 153, the lower wing plate 154 and the loading element 13, so as to position the mainframe 10, and prevent the mainframe 10 from turning freely under external forces.

Alternatively, the upper wing plate 153 is provided with an arc-shaped guide slot 156. The arc center of the guide slot 156 is located at the axial center of the second bolt 152. The lower wing plate 154 is provided with a plurality of second positioning holes 157. Each of the second positioning holes 157 are respectively and vertically corresponding to the guide slot 156. The positioning pin 155 can move up and down through the guide slot 156, the loading element 13 and the selected second positioning hole 157. A lever-form pulling element 19 is pivoted on the loading element 13. The pulling element 19 is protruded with two clamping arms 192. The clamping arms 192 relatively clamp the positioning pin 155, so as to pull the positioning pin 155 upward to withdraw from the second positioning hole 157.

When the positioning pin 155 goes through the guide slot 156, the loading element 13 and the selected second positioning hole 157, the mainframe 10 cannot rotate freely. When the position of the vertical post 11 in relation to the support 92 is changed, the pulling element 19 can be operated for the positioning pin 155 to move upward to leave the second positioning hole 157, and the mainframe 10 can be rotated around the first bolt 142 and the second bolt 152. The positioning pin 155 slides along the guide slot 156. When the mainframe 10 is rotated to the required position, the positioning pin 155 moves down into another selected second positioning hole 157, and the mainframe 10 is thus fixed.

Figure 11:
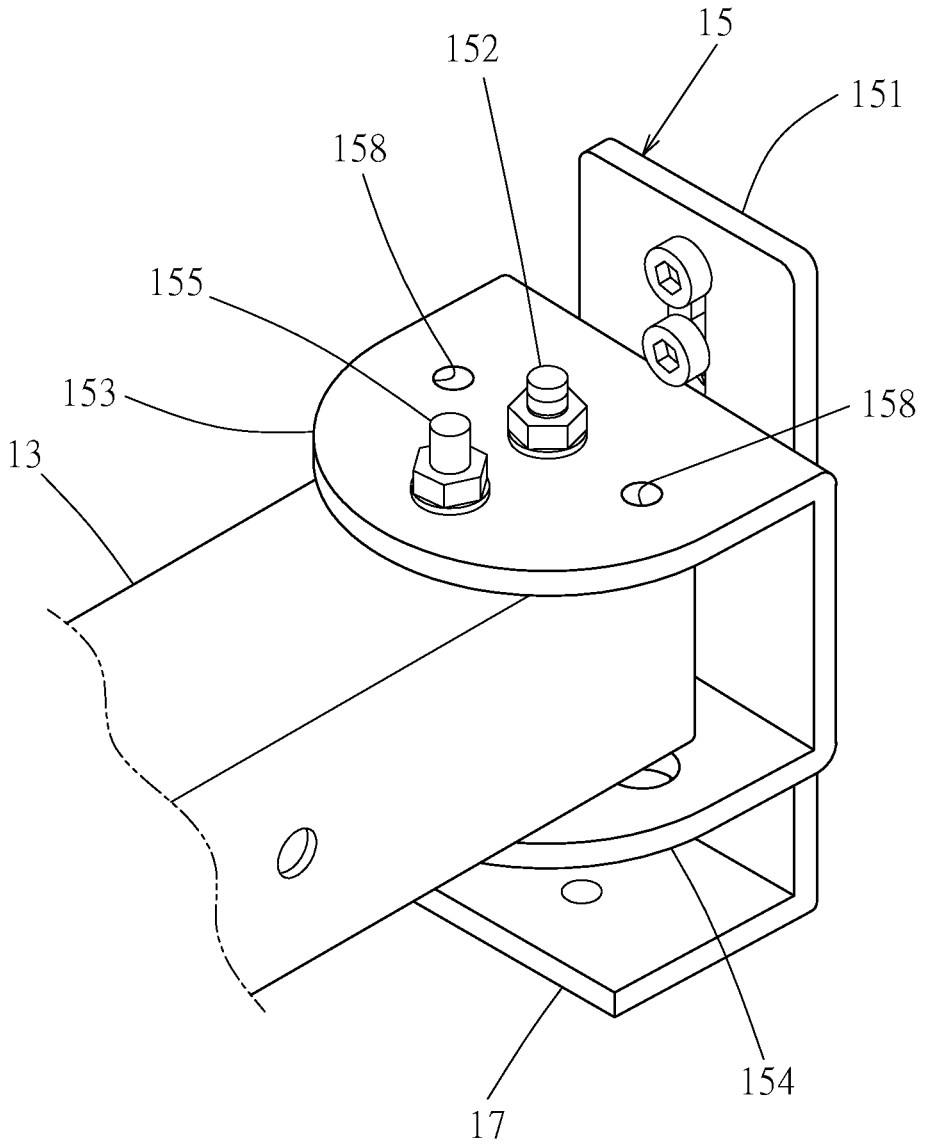
FIG. 11 is a partial perspective view of Embodiment 3 of the invention, showing the second connection structure.
Figure 12:
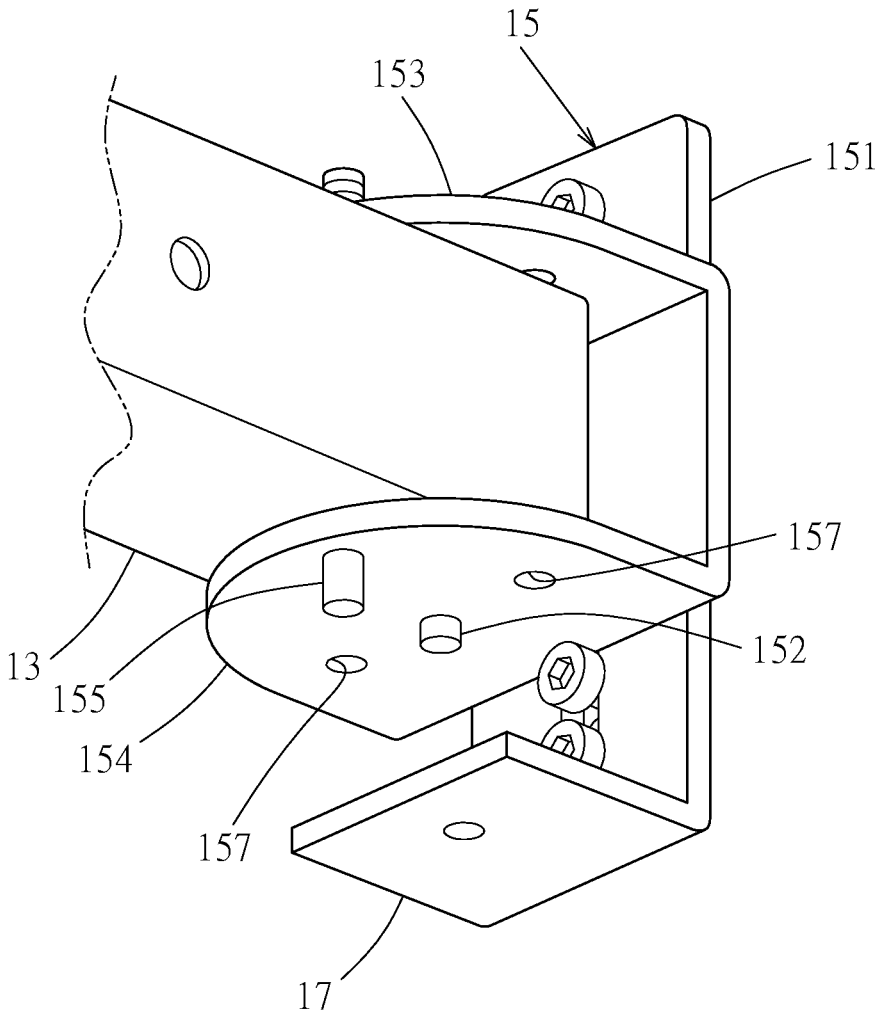
FIG. 12 is a partial perspective view of Embodiment 3 of the invention from another angle, showing the second connection structure.

Referring to FIG. 11 and FIG. 12, Embodiment 3 differs from Embodiment 2 in that, the upper wing plate 153 is provided with a plurality of third positioning holes 158 to substitute for the guide slot 156, the lower wing plate 154 is provided with a plurality of second positioning holes 157. Each of the third positioning holes 158 is respectively corresponding to each of the second positioning holes 157. The positioning pin 155 goes through the selected third positioning hole 158, the loading element 13 and the corresponding second positioning hole 157. The positioning pin 155 is pulled upward away from the third positioning hole 158, the loading element 13 and the second positioning hole 157, and the mainframe 10 can be rotated. When the mainframe 10 is rotated to the required position, the positioning pin 155 can be inserted into the selected third positioning hole 158, the loading element 13 and the corresponding second positioning hole 157.

I claim:

1. A rope pull training device comprising:

a main frame having a vertical post and an upper beam and a loading element, wherein the vertical post is formed with a plurality of first positioning holes along an axle, the upper beam and the loading element being vertically opposite to each other, the vertical post being connected to the upper beam and the loading element, the upper beam being connected to a first connection structure, the loading element being connected to a second connection structure, the first connection structure and the second connection structure being connected to a support such that said main frame is fixable onto the support;

a pair of pulley units respectively comprising a plurality of fixed pulleys, the plurality of fixed pulleys being configured on said main frame;

a resisting unit connected to said main frame;

a guiding structure having a sleeve and a pair of wheel seats and a pair of first guide wheels and a pair of second guide wheels, the sleeve being sleeved on the vertical post and slidable back-and-forth along the vertical post, one hole of the plurality of first positioning holes having a pin rod fitted therein so as to position the sleeve, the pair of wheel seats being laterally opposite to each other and pivotally mounted on the sleeve such that each of the pair of wheel seats is rotatable relative to the sleeve, wherein each of the pair of wheel seats has a side plate, the side plate of each of the pair of wheel seats being respectively pivotally mounted on one of the pair of first guide wheels and one of the pair of second guide wheels, wherein the pair of first guide wheels and the pair of second guide wheels are vertically adjacent to each other;

a pair of laterally opposite hauling ropes respectively winding around the plurality of fixed pulleys such that said pair of laterally opposite hauling ropes are on each of said pair of pulley units, each of said pair of laterally opposite hauling ropes being respectively connected to the sleeve, each of said pair of laterally opposite hauling ropes respectively extending through each of the pair of wheel seats, one end of said pair of laterally opposite hauling ropes adjacent to the pair of wheel seats being connected to a handle, wherein said pair of laterally opposite hauling ropes extend between the pair of first guide wheels and the pair of second guide wheels from one side of the pair of first guide wheels facing the sleeve, wherein the pair of first guide wheels and the pair of second guide wheels restricting of said pair of laterally opposite hauling ropes so as to guide the pair of laterally opposite hauling ropes, wherein the side plate of each of the pair of wheel seats laterally limit said pair of laterally opposite hauling ropes so as to prevent said pair of laterally opposite hauling ropes from falling off the pair of first guide wheels and the pair of second guide wheels, wherein each of said pair of laterally opposite hauling ropes has a lifting section;

a pair of movable pulleys, wherein each lifting section of said pair of laterally opposite hauling ropes respectively winds around a bottom edge of each of said pair of movable pulleys, each of said pair of movable pulleys respectively pressing each lifting section of said pair of laterally opposite hauling ropes downwardly such that each of said pair of laterally opposite hauling ropes is in a tightened state, each of said pair of laterally opposite hauling ropes respectively pulls each of said pair of movable pulleys so as to move back-and-forth toward or away from said resisting unit; and a pair of connecting ropes respectively connected to each of said pair of movable pulleys, each of said pair of connecting ropes being connected to said resisting unit, wherein said resisting unit provides a resisting force against each of said pair of laterally opposite hauling ropes through each pair of movable pulleys.

2. The rope pull training device of claim 1, wherein the first connection structure has a first frame body and a first bolt, the first frame body being connected to the support, the first bolt extending vertically through the first frame body and the upper beam, the second connection structure having a second frame body having a second bolt, the second frame body being connected to the support, the second bolt extending vertically through the second frame body and the loading element, wherein the upper beam and the loading element respectively rotate around the first bolt and the second bolt.

3. The rope pull training device of claim 2, wherein said second frame body has an upper wing plate and a lower wing plate, the upper wing plate and the lower wing plate being respectively adjacent to a top edge and a lower edge of the loading element, the second bolt extending vertically through the upper wing plate and the lower wing plate and the loading element, wherein a positioning pin extends through the upper wing plate and the lower wing plate and the loading element so as to position said main frame.

4. The rope pull training device of claim 3, wherein the upper wing plate has an arc-shaped guide slot, a center of the arc-shaped guide slot being positioned at a center of the second bolt, the lower wing plate having a plurality of second positioning holes, each of the plurality of second positioning holes being vertically aligned with the arc-shaped guide slot, the loading element having a lever-shaped pulling element pivotally mounted thereto, wherein the positioning pin extends through the arc-shaped guide slot and the loading element and one hole of the plurality of second positioning holes, wherein the lever-shaped pulling element has a pair of clamping arms extending therefrom, each of the pair of clamping arms clamping the positioning pin so as to pull the positioning pin upwardly in order to withdraw from the one hole of the plurality of second positioning holes.

5. The rope pull training device of claim 3, wherein the lower wing plate has a plurality of second positioning holes, the upper wing plate having a plurality of third positioning holes, each of the plurality of third positioning holes being respectively and vertically aligned with each of the plurality of second positioning holes, wherein the positioning pin extends through a select one hole of the plurality of third positioning holes and the loading element and a select one hole of the plurality of second positioning holes.

6. The rope pull training device of claim 1, wherein said resisting unit has a reel structure and a resisting structure, wherein the reel structure and the resisting structure are aligned with each other, the reel structure being configured to wind and release each of a plurality of connecting ropes released by the reel structure.

7. The rope pull training device of claim 6, wherein the reel structure has a first shaft and a pair of winding wheels, the first shaft extending through each of the pair of winding wheels, each of said plurality of connecting ropes being respectively connected to each of the pair of winding wheels, each of said plurality of connecting ropes being respectively wound around a radial periphery of each of the pair of winding wheels such that each of the pair of winding wheels respectively winds or releases each of the plurality of connecting ropes, wherein a rotational direction of each of the pair of winding wheels when winding the plurality of connecting ropes is defined as a winding direction, wherein a rotational direction of each of the pair of winding wheels when releasing the plurality of connecting ropes is defined as a releasing direction, each of the pair of winding wheels respectively pulls a first shaft so as to have unidirectional rotation along the releasing direction, each of the pair of winding wheels being respectively configured to automatically wind each of the plurality of connecting ropes along the winding direction.

8. The rope pull training device of claim 1, wherein said main frame has a connecting plate, the connecting plate being adapted to connect to an external structure.

* * * * *